United States Patent [19]

Nederbragt

[11] Patent Number: 5,020,640

[45] Date of Patent: Jun. 4, 1991

[54] ELEVATOR BRAKE

[75] Inventor: Jacob A. Nederbragt, Akersloot, Netherlands

[73] Assignee: Bongers & Deimann, Dusseldorf, Fed. Rep. of Germany

[21] Appl. No.: 401,989

[22] Filed: Sep. 1, 1989

[30] Foreign Application Priority Data

Sep. 10, 1988 [DE] Fed. Rep. of Germany ..... 3830865
May 26, 1989 [DE] Fed. Rep. of Germany ..... 3917594

[51] Int. Cl.[5] ..... B66B 5/16
[52] U.S. Cl. ..... 187/89; 187/108
[58] Field of Search ..... 187/73, 89, 90, 91, 187/17, 38, 39, 45, 108, 109, 110

[56] References Cited

U.S. PATENT DOCUMENTS 4,284,175 8/1981 Ishii et al. ..... 187/109

FOREIGN PATENT DOCUMENTS 51394 11/1966 German Democratic Rep. .
109597 11/1974 German Democratic Rep. .
145724 9/1982 Japan ..... 187/73
673575 3/1976 U.S.S.R. ..... 187/89
1096184 6/1984 U.S.S.R. ..... 187/89
1191406 11/1985 U.S.S.R. ..... 187/73

*Primary Examiner*—Robert P. Olszewski
*Assistant Examiner*—Kenneth Noland
*Attorney, Agent, or Firm*—Toren, McGeady & Associates

[57] ABSTRACT

In an elevator brake that includes brake jaws acting on at least one bearer rope and a device for applying the brake, the speed of the elevator car is monitored by an impulse relay. This relay is connected to a pulse generator that includes a roller driven by the bearer rope of the elevator car. If the speed of the elevator car is too high, a switching signal applying the brake is given before an arresting device responds.

7 Claims, 1 Drawing Sheet

ELEVATOR BRAKE

TECHNICAL FIELD OF THE INVENTION

The present invention relates to an elevator brake that includes brake jaws acting on at least one bearer rope and means for applying the brake.

BACKGROUND OF THE INVENTION AND PRIOR ART

The cars or cages of electric elevators are moved by means of bearer or hoisting ropes. Where a drum drive is used, the car is moved by winding and unwinding the bearer rope around a drum provided with spiral grooves. Such drum drives are for the most part only permitted for elevators without counterweights and only for operating speeds of up to 0.5 m/s. In the case of pulley drives the bearer rope is carried along by the drive pulley by friction contact. The elevator car is fixed to one end of the bearer rope and the counterweight to the other end. The car and the counterweight run in guides. The counterweight normally amounts to the weight of the car plus half the permitted load.

Now if the car is empty or only lightly loaded it may happen, for example as a result of breakage of the ring gear transmitting the driving and braking forces to the driving pulley of a pulley drive, that the driving pulley and its shaft are free to rotate. The excess weight on the counterweight side of the bearer rope then pulls the car up at ever-increasing speed, and the acceleration when the weights are not in balance is further progressively increased by the lower part of the rope as the weight of the bearer rope is transferred from the car strand to the counterweight strand of the bearer rope.

The resulting uncontrolled upward movement of the elevator car, which is also known as an "upward crash", can cause accidents if the arresting device prescribed by the safety regulations is only effective in the case of upward travel.

An elevator brake aimed at preventing an upward crash, having brake jaws that act on at least one bearer rope, is known from The Netherlands patent specification 80 017. If the speed of the bearer rope, either upwards or downwards, exceeds a limiting value the brake is applied in a speed-dependent manner.

OBJECT OF THE INVENTION

Starting from here, it is an object of the invention to provide an elevator brake that acts in both directions, is applied electrically, and can operate in place of a conventional arresting device or, if there is an arresting device, can switch off the elevator drive before the arresting device is actuated so that the elevator can be put back into operation with considerably less trouble.

SUMMARY OF THE INVENTION

For this purpose the invention provides a safety switch, for example a relay, that actuates the brake applying means, the switch being pulse count dependent and actuated in a pulse circuit by a pulse generator responsive to a part of the elevator installation that moves dependent on the speed of the elevator car.

To enable monitoring also to be carried out when the car is at a standstill, a further monitoring switch can be used that is connected in series with the safety switch and is controlled by the pulse generator, and applies the elevator brake if the car begins to move or is in motion when there is no command to move. A further monitoring switch, likewise connected in series with the safety switch and controlled by the pulse generator, provides a means of self-monitoring or start-up monitoring: this switch acts if the pulse generator should be defective or if as a result of some other fault no pulses are detected at the three switches even though a movement command has been given.

Finally, a further cut-out switch can be connected in series with the three pulse count dependent switches or relays that is operated by application of the brakes, i.e. it opens in the case of braking in order to open the safety circuit and to prevent any further operation of the elevator other than emergency manual operation.

The safety circuit can thus include three pulse count dependent switches, preferably relays, and an electromagnetic brake-applying device coupled with a cutout switch.

The two monitoring switches preferably operate with time delay so as to prevent immediate response to the start-up and standstill monitoring systems connected with these switches. The electromagnetic braking system operates the cut-out switch located in the safety circuit and the brake jaws of the elevator brake that act on at least one bearer rope either directly, e.g. through a rod, or indirectly, e.g. through a medium flowing through electromagnetically controllable passages therein. In parallel with the two time-delayed, pulse count dependent monitoring switches and the cut-out switch connected to the electromagnetic braking system there is a manual switch that makes manually operated travel possible after application of the elevator brake. Impulse relays are particularly suitable for use as pulse count dependent switches.

The pulse generator can include a roller of electrically insulating material that has a metal insert and runs on a component of the elevator installation, for example a bearer rope, whose movement is dependent on the speed of the elevator car.

BRIEF DESCRIPTION OF THE DRAWINGS

The invention will now be explained in more detail, by way of example, with reference to the embodiment shown in the drawings, in which.

DETAILED DESCRIPTION OF A PREFERRED EMBODIMENT OF THE INVENTION

Figure 3:
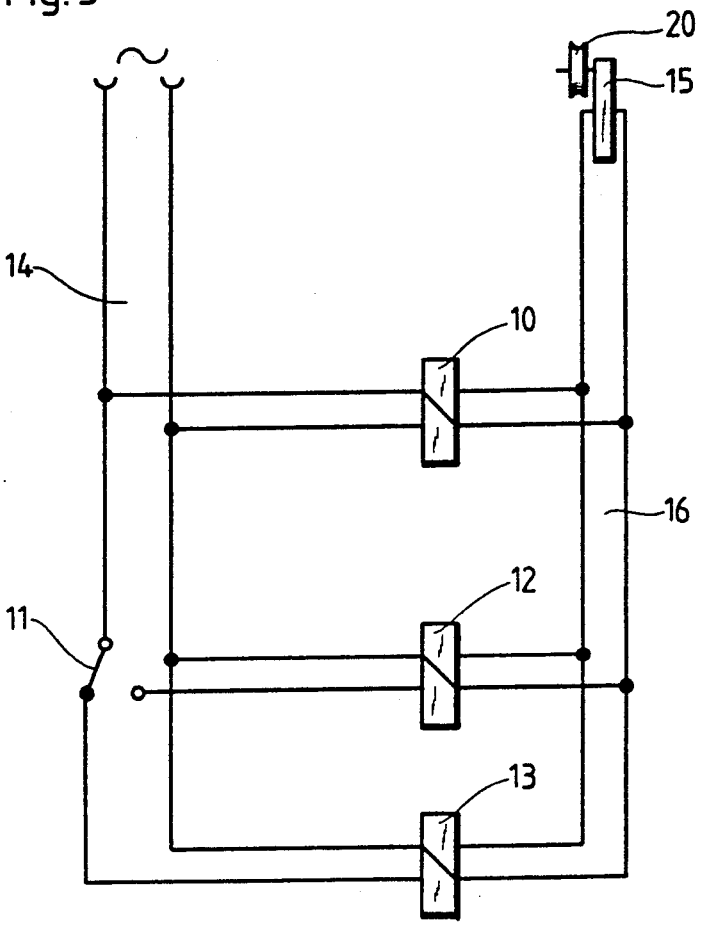
FIG. 3 is a circuit diagram of the switching circuit.
Figure 2:
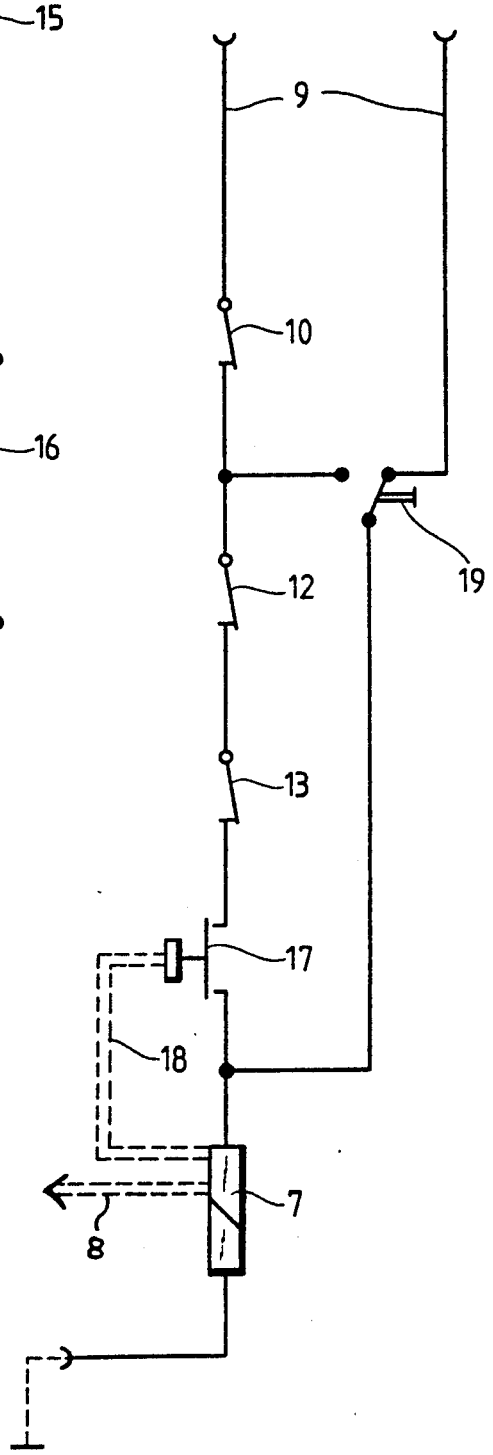
FIG. 2 is a circuit diagram of the switching circuit.
Figure 1:
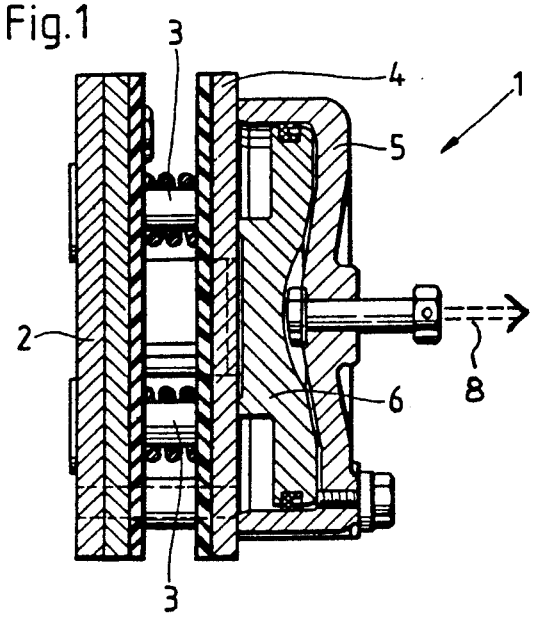
FIG. 1 is a side view of a compressed air brake for a bearer rope.

The bearer rope brake 1 comprises a fixed brake jaw 2 and a brake jaw 4, guided on bolts 3, that is movable against spring pressure and is fixed to a piston 6 that can move in a compressed air cylinder 5. The compressed air is supplied to the cylinder chamber through a compressed air line 8 that can be closed by an electromagnetic valve 7.

An electrical safety circuit 9 comprises a pulse count controlled safety relay 10 that serves as a speed monitoring system, a time delayed monitoring relay 12 that is supplied with current on its energising side during the travel and slowing down time of the lift by a two-way switch 11 that is operated by a movement command, and a further monitoring relay 13 that serves to monitor start-up and which is switched off after a time delay if no pulses are detected despite a movement command. The relays 10, 12, 13 have their energising sides in a current supply circuit 14 and their control sides, together with a pulse generator 15, in a pulse circuit 16.

A compressed air switch 17 is located in the safety circuit 9 in series with the three relays 10, 12, 13 and, when the electromagnetic valve 7 is attracted, is supplied with compressed air via a compressed air line 18 so that its contacts are closed. In addition, a manual switch 19 is connected in parallel to the two series-connected monitoring relays 12 and 13 and the compressed air switch 17. In its closed position the manual switch 19 by-passes the impulse relays 12, 13 for the start-up and standstill monitoring and the compressed air switch 17 that is open when the brake 1 is applied, so that manually operated travel is possible after releasing the bearer rope brake 1 even when one of the relays 12, 13 or the compressed air switch 17 is open. The safety relay 10 that monitors excessive speed does not need to be bypassed by the manual switch 19 in case of a fault, since in the inoperative position, which it takes up after the bearer rope brake 1 is applied, it is attracted. The individual safety functions are actuated as follows:

In the event of the maximum permitted speed of the elevator car being exceeded, the safety relay 10 responsible for speed monitoring is opened at a predetermined threshold value by the car speed dependent pulses coming from the pulse generator 15. For this purpose a pulse generator roller 20 runs on a bearer rope that moves at a speed corresponding to that of the elevator car. The safety relay 10 should interrupt the safety circuit 9 when the car speed is about 15% too high, and in any event before the generally prescribed condition for actuation of the arresting device. To ensure that the car comes to a stop and remains stationary after the speed monitoring system has responded, the compressed air switch 17 becomes pressureless after the opening of the electromagnetic valve 7 and opens its contacts, so that the safety relay 10 remains ineffective even if it is attracted again as the car speed drops below the triggering value of the speed monitoring system.

The standstill monitoring by the relay 12 is only activated when the two-way switch 11 located in the pulse circuit 16 is in its right-hand position. The two-way switch 11 is preferably mechanically coupled to the movement controls of the elevator installation, so that a movement command automatically moves it into the left-hand position and thus disables the standstill monitoring system during the travel. At the end of a journey of the elevator the relay 12 responsible for the standstill monitoring is automatically connected to the pulse generator 15 through the switch 11 and the pulse circuit 10 and opens, after a delay time, if pulses from the pulse generator 15 enter its excitation winding despite the absence of a movement command. This is for example the case if, for example as a result of brake failure, the car gradually sinks or rises from its rest position opposite a door of the elevator. However, in order to prevent the standstill monitoring system from responding as a result of stretching of the bearer rope under a load within the permitted limit, the monitoring relay 12 switches off, with a time delay, after a predetermined number of pulses corresponding to a movement of the car by, say, 6 cm, after the rope brake 1 has gripped or the car has sunk from its rest position owing to increased loading.

The start-up monitoring system using the relay 15 which is switched on during travel and slowing-down responds if, after a preset running time of say 5 seconds, no pulses are received at the field winding of the time-delayed impulse relay 15. This will, for example, be the case if for any reason the eleVator is mechanically blocked or the pulse generator 15 is defective, e.g. because its roller is not running properly on the bearer rope, so that none of the three relays 10, 12, 13 is able to operate.

What is claimed is:

1. An elevator brake, comprising:

brake jaws acting on at least one bearer rope;

brake applying means;

a safety switch that actuates the brake applying means, said safety switch being pulse count dependent and being actuated in a pulse circuit by a pulse generator responsive to a part of the elevator installation that moves dependent on the speed of the elevator car; and at least one time delayed, pulse count dependent monitoring switch connected in a series with said safety switch in a safety circuit and controlled through said pulse generator in said pulse circuit so as to actuate the brake applying means when the elevator car begins to move from a stopped position or is in motion when no command to move is present, and so as to monitor start-up of the elevator.

2. An elevator brake according to claim 1, further comprising a cut-out switch connected in series with said safety switch and connected to the brake applying means so as to open the safety circuit and so as to allow only manual operation of the elevator once said brake applying means is activated.

3. An elevator brake according to claim 1, further comprising a cut-out switch connected in series with said safety and monitoring switches and connected to a brake applying system so as to open the safety circuit and so as to allow only manual operation of the elevator once said brake applying means is activated.

4. An elevator brake according to claim 1, wherein a manual switch is connected in parallel with at least one of said safety and monitoring switches so as to allow manual operation of said brake applying means.

5. An elevator brake according to claim 1, wherein said pulse generator includes a roller of insulating material with a metal insert arranged to run on a component of the elevator installation whose movement is dependent on the speed of the elevator car.

6. An elevator brake, comprising:

brake jaws acting on at least one bearer rope;

brake applying means;

a safety switch that actuates the brake applying means, said safety switch being pulse count dependent and being actuated in a pulse circuit by a pulse generator responsive to a part of the elevator installation that moves dependent on the speed of the elevator car;

at least one timed delayed, pulse count dependent monitoring switch connected in a series with said safety switch in a safety circuit and controlled through said pulse generator in said pulse circuit so as to actuate the brake applying means when the elevator car begins to move from a stopped position or is in motion when no command to move is present, and so as to monitor start-up of the elevator;

a manual switch connected in parallel with at least one of said safety and monitoring switches; and a two-way switch located in the current supply circuit of said safety and monitoring switches.

7. An elevator brake according to claim 6 wherein said two-way switch is arranged to automatically connect at least one of said monitoring switches to said pulse generator at the end of a journey of the elevator.

* * * * *